US006231336B1

(12) United States Patent
Chen

(10) Patent No.: US 6,231,336 B1
(45) Date of Patent: May 15, 2001

(54) STRUCTURE OF A SHADE FOR A CANDLE

(76) Inventor: Hsi-Chin Chen, P.O. Box 82-144, Taipei (TW)

( * ) Notice: Subject to any disclaimer, the term of this patent is extended or adjusted under 35 U.S.C. 154(b) by 0 days.

(21) Appl. No.: 09/548,008

(22) Filed: Apr. 12, 2000

(51) Int. Cl.[7] ..... F23D 3/16
(52) U.S. Cl. ..... 431/291; 362/163
(58) Field of Search ..... 431/291, 289, 431/295, 288; 126/44, 45, 43, 95, 96; 362/163, 186, 161, 159, 314

(56) References Cited

U.S. PATENT DOCUMENTS 1,975,496 * 10/1934 Barrett, Jr. ..... 431/291
2,001,377 * 5/1935 Candy, Jr. ..... 431/291
2,254,664 * 9/1941 Quinlan ..... 431/291
5,881,709 * 3/1999 Daoust ..... 126/44

* cited by examiner

*Primary Examiner*—James C. Yeung
(74) *Attorney, Agent, or Firm*—A & J

(57) ABSTRACT

The present invention relates to a shade structure for a candle, and in particular, the shade structure comprising a container body for containing a candle, a shade body with a center air hole and detachably mounted onto the circumferential edge of the container body, and a covering plate having a center hole aligned with the center air hole of the shade body. The shade body is provided with a plurality of auxiliary openings which are corresponding to a plurality of through holes provided on the upper edge of the covering plate. The covering plate can be rotated with respect to the shade body such that the through holes align with the auxiliary openings and this will control convection of air within the container body. The temperature within the container body is thus regulated by adjusting the covering plate with respect to the shade body.

3 Claims, 4 Drawing Sheets

STRUCTURE OF A SHADE FOR A CANDLE

BACKGROUND OF THE INVENTION a) Technical Field of the Invention

The present invention relates to a structure of a shade for a candle, and in particular, a shade body and a covering plate, both provided with a plurality of auxiliary openings and a plurality of through holes respectively. The covering plate can be rotated with respect to the shade body until the openings and the holes are aligned so that state of burning candle within the container body can be regulated.

b) Description of the Prior Art

FIGS. 5 shows a conventional candle shade having a container body 30 with an open end having a stepped ring 31 to accommodate a shade body 40. This structure prevents the blowing of strong wind which will extinguish the burning candle within the container body.

This conventional structure allows the burning candle to burn in a very stable manner and the hot air of the burning candle is kept within the container body 30. This structure is effective in lighting the wick of the candle during winter. However, in such conventional design, a center opening 32 is provided to the shade body 40 so that the flame of the candle can reach outside the container body, and a plurality of apertures 33 are provided along the circumferential edge of the shade body 40. As shown in FIG. 6, hot air rises and the hot air is dispersed out via the center opening 32. In this case, the speed of dispersion of hot air is slow. In summer, due to the hot air which is accumulated at the top portion of the container body 30, the top part of the candle will be melted and at this instance, the wick 34 of the candle will become longer and the flame of the burning becomes larger. As shown in FIG. 7, the flame will move in accordance with the convection of air. As a result, the flame may be blown so close to the container body 30 which will damage the wall of the container body 30. In addition, the melted wax may flow out of the container body 30, which further causes a danger to the user.

SUMMARY OF THE INVENTION

To save the aforementioned problems, it is an object of the present invention to provide a structure of a shade for a candle, wherein the through holes provided on the covering plate can be adjusted to correspond with the auxiliary openings of the shade body so as to provide an optimum size of the opening for air passage, which in turn, provide convection air for the burning candle, thereby the effectiveness of candle burning is obtained.

Yet another object of the present invention is to provide a structure of a shade for a candle, wherein a plurality of protruded decorative discs are provided along the edge of the covering plate, adjacent to the through holes, thereby an aesthetic appearance for a candle shade is thus obtained.

Yet another object of the invention is to provide a structure of shade for a candle which is comparatively compact and light in weight.

Other objects, features and advantages of the invention will be apparent from the following description when read with reference to the accompanying drawings.

DETAILED DESCRIPTION OF THE PREFERRED EMBODIMENT

Figure 1:
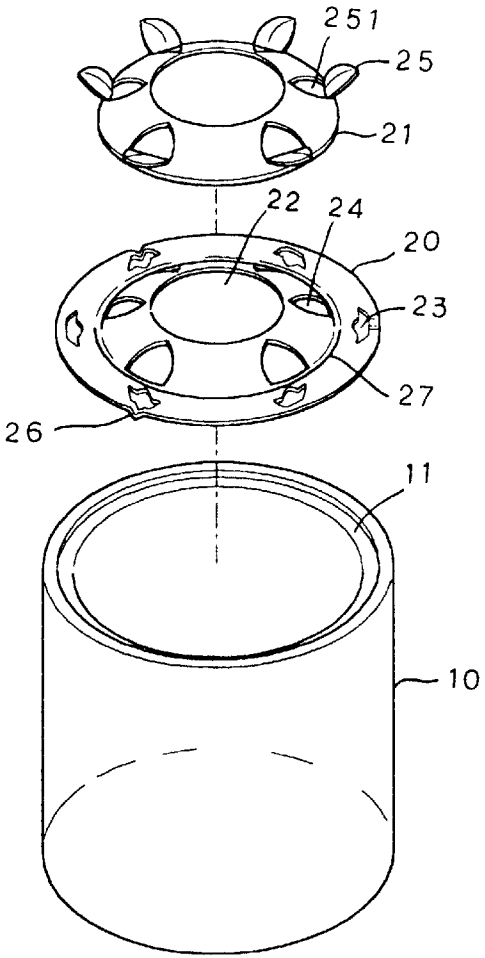
FIG. 1 is a perspective exploded view of a structure of a shade for a candle in accordance with the present invention.
Figure 2:
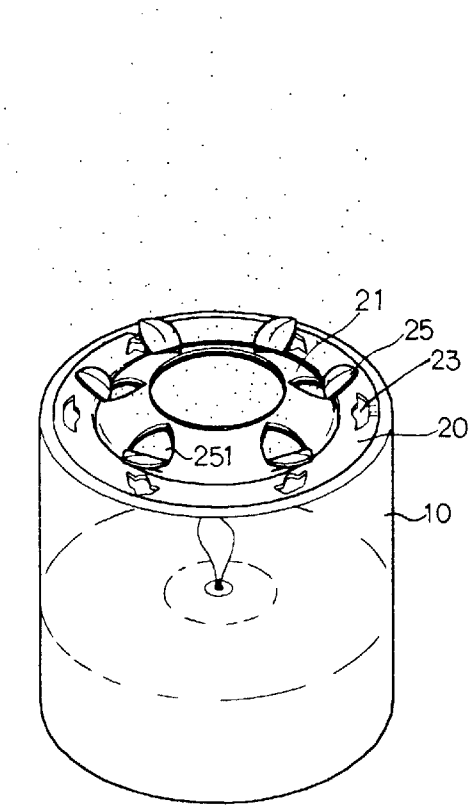
FIG. 2 schematically shows a structure of a shade for a candle in accordance with the present invention.
Figure 3:
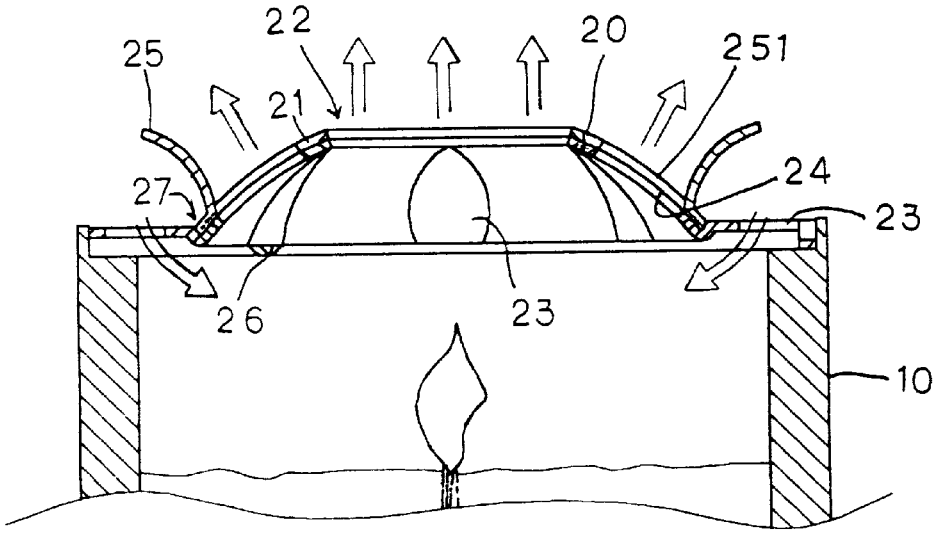
FIG. 3 schematically shows the convection of air of a burning candle in accordance with the present invention.
Figure 5:
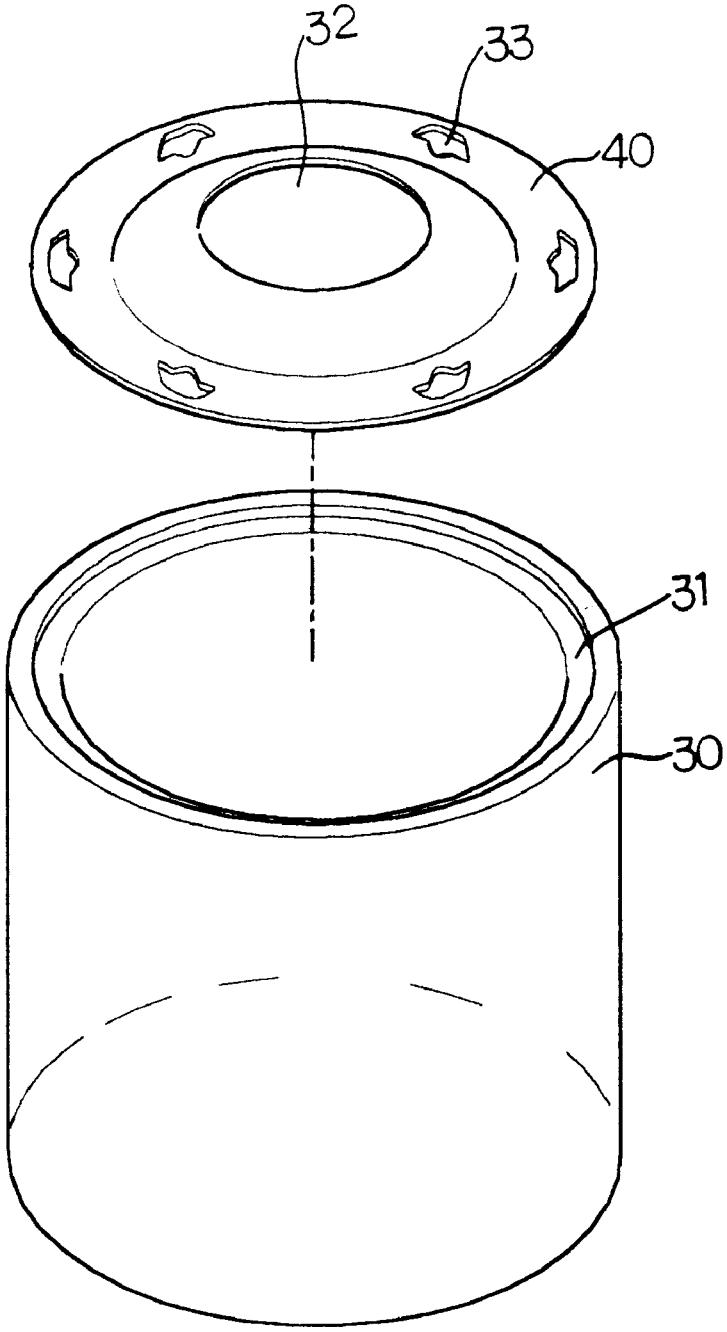
PRIOR ART FIG. 5
FIG. 5 is a perspective exploded view of a conventional shade for a candle.
Figure 6:
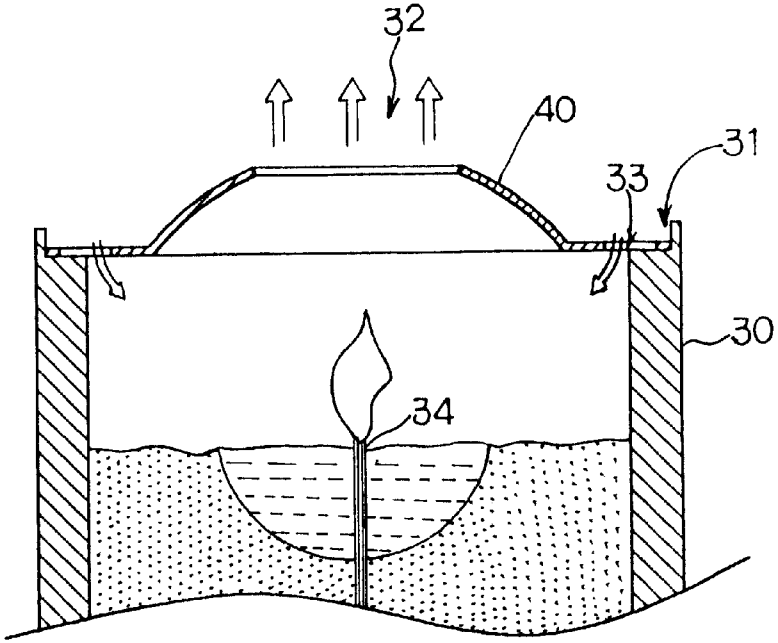
PRIOR ART FIG. 6
FIG. 6 is a schematic view showing the convection of air of a conventional shade for a candle.
Figure 7:
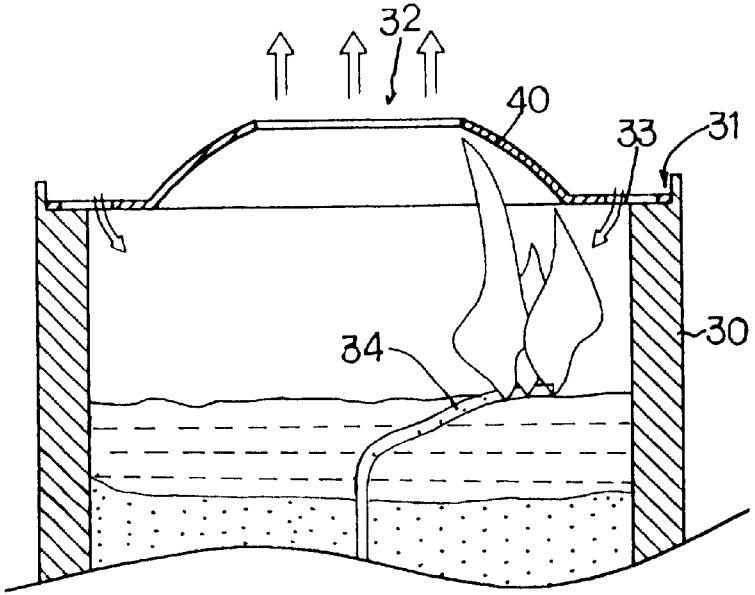
PRIOR ART FIG. 7
FIG. 7 schematically shows the candle within the conventional shade where the flame of the candle is excessively large.

FIGS. 1 to 3 show a structure of a shade for a candle in accordance with the present invention. The shade structure comprises a container body 10 having an open end, a shade body 20, and a covering plate 21. The open end of the container body 10, along the circumferential edge thereof is provided with a recessed stepped ring 11, which is adaptable to the circumferential edge of the shade body 20, which is detachably mounted onto the top of the open end. In accordance with the present invention, the covering plate 21 is rotatably and detachably mounted onto the shade body 20. The shade body 20 has a curved region at the center thereof, containing a plurality of auxiliary openings 24 and a center air hole 22 is provided to the center of the shade body 20. A plurality of apertures 23 are provided along the top circumferential edge of the shade body 20 to allow convection flow of air into the container body 10. In accordance with the present invention, the shape of the auxiliary openings 24 can be circular, oval, rectangular, square or rhombic shape. The top of the covering plate 21 is provided with a plurality of through holes 251, which can be rotatably adjusted to corresponding to the auxiliary openings 24 of the shade body 20 by rotating the covering plate 21 with respect to the shade body 20. A plurality of protruded decorative discs 25 are provided on the covering plate 21, adjacent to the through holes 251 of the covering plate 21. The decorative discs 25 provide the entire shade structure with an aesthetic appearance. In order to stably mount the shade body 20 onto the stepped ring 11, a plurality of protrusions 26 are provided to the bottom circumferential edge of the shade body 20.

In order to moveably rotate the covering plate 21 with respect to the shade body 20, the user can push the decorative discs 25 until the through holes 251 and the auxiliary openings 24 overlap or correspond with each other. Based on burning requirements, the size of the openings 24 is adjusted by adjusting/rotating the covering plate 21.

Figure 4:
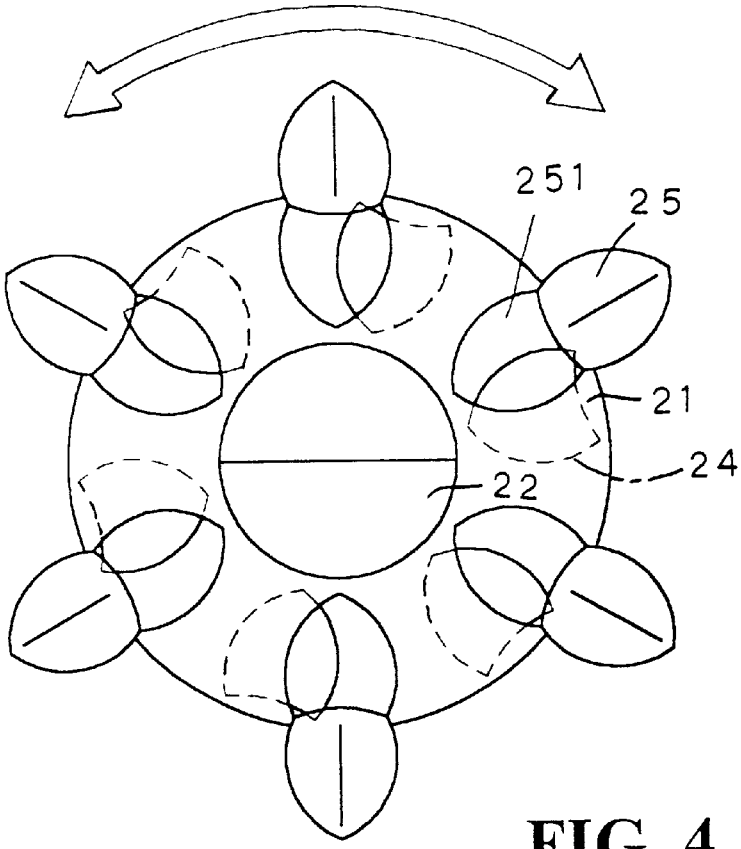
FIG. 4 is a schematically view showing the rotatably adjustment of the covering plate of the shade in accordance with the present invention.

As shown in FIG. 4, when the room temperature is high, the heat within the container body 10 may not be easily dispersed to the outside. For this instance, the covering plate 21 is appropriately moved with respect to the shade body 20 such that the protruded decorative discs 25 (or the through holes 251) are corresponding to the auxiliary openings 24 of the shade body 20, forming a through opening. This will allow hot air within the container body 10 to disperse through the air holes 22 and the auxiliary openings 24. Thus, the temperature within the container body 10 is effectively regulated, and this assures that the temperature at the top part of the container body 10 is not high enough to melt the candle. During winter, the protruded discs 25 are moved to a position in between two auxiliary openings 24 so that the container body 10 has a comparatively larger sealed space to retain the heat.

In accordance with the present invention, a recessed circular slot 27 is provided at the lower section of the curved surface of the shade body 20, such that the lower circumferential edge of the covering plate 21 can be rotatably and detachably mounted.

While the preferred embodiment of a shade for a candle is illustrated, this embodiment is presented by way of example only and not in a limiting sense. The invention in brief comprises all the embodiments and modifications coming within the scope and spirit of the following claims.

I claim:

1. Structure of a shade for a candle comprising a cylindrical body having an open end, a shade body detachably mounted to the open end of the cylindrical body, and a covering plate detachably and rotatably mounted on a top of the shade body, characterized in that the shade body has a central portion formed with a convex portion having a plurality of auxiliary openings, a circumferential edge of the shade body is provided with a plurality of apertures, the shade body is provided with a center air hole, the covering plate is provided with a center hole corresponding to the center air hole of the shade body, a circumferential edge of the covering plate is provided with a plurality of through holes, a plurality of protruded decorative discs are provided adjacent to the through holes, the covering plate is rotatably mounted onto the shade body, thereby, rotatable adjustment of the covering plate controls convection of air within the cylindrical body.

2. The structure of a shade for a candle as set forth in claim 1, wherein a recessed circular slot is provided on the shade body for rotatably mounting with the edge of the covering plate, facilitating the rotation of the covering plate with respect to the shade body.

3. The structure of a shade for a candle as set forth in claim 1, wherein the shade body is provided with a plurality of protrusions for mounting of the shade body on the open end of the cylindrical body.

* * * * *